US005496234A

United States Patent [19]

Sussich

[11] Patent Number: 5,496,234

[45] Date of Patent: Mar. 5, 1996

[54] ENDLESS ROPE EXERCISE DEVICE

[75] Inventor: Marino Sussich, Werribee, Australia

[73] Assignee: Creswin Pty. Ltd., Victoria, Australia

[21] Appl. No.: 325,357

[22] PCT Filed: Apr. 6, 1993

[86] PCT No.: PCT/AU93/00149

§ 371 Date: Oct. 26, 1994

§ 102(e) Date: Oct. 26, 1994

[87] PCT Pub. No.: WO93/22003

PCT Pub. Date: Nov. 11, 1993

[30] Foreign Application Priority Data

Apr. 28, 1992 [AU] Australia ..... PL2094
Nov. 25, 1992 [AU] Australia ..... PL6015

[51] Int. Cl.[6] ..... A63B 21/018

[52] U.S. Cl. ..... 482/37; 482/114; 482/120

[58] Field of Search ..... 482/37, 114, 115, 482/118, 120

[56] References Cited

U.S. PATENT DOCUMENTS 3,599,974 8/1971 Price .
5,112,043 5/1992 Gilfillian, Jr. ..... 482/37
5,171,295 12/1992 Schwaim, Jr. .
5,316,535 5/1994 Bradbury ..... 482/114

*Primary Examiner*—Richard J. Apley
*Assistant Examiner*—Lynne A. Reichard
*Attorney, Agent, or Firm*—Larson and Taylor

[57] ABSTRACT

An exercise device is described comprising frame means, a wheel mounted to said frame means, a second wheel mounted to said frame means spaced from the first wheel, and an endless rope, or cord, passing over the wheels, which are spaced to keep the rope, or cord, taut. Means are provided for applying friction to one of the wheels mounted to said frame means which will apply a restraint to the rope, or cord, which must be overcome by an exercising person pulling on the rope, or cord. The frame means is rotatably mounted to a sub-frame by a central pivot support for rotation relative to said sub-frame and locking means is provided to permit a desired angle of rotation to be held for particular arm related exercises. The mounting by the particular arm related exercises, the mounting by the central pivot support permitting rotation to be held for particular arm related exercises, the mounting by said central pivot support permit rotation so the rope, or cord, can extend between vertically and horizontally extending positions between the wheel and the second wheel generally directly in front of a user.

5 Claims, 2 Drawing Sheets

ENDLESS ROPE EXERCISE DEVICE

FIELD OF THE INVENTION

This invention relates to exercising and relates particularly, but not exclusively, to an exercise device for developing strength to one's arms, fingers, hands, wrists, triceps, and shoulders.

DESCRIPTION OF PRIOR ART

Hitherto, exercises for developing forearms, fingers, hands, wrists, triceps and shoulders has involved dedicated exercises having regard to particular exercise equipment which is available. Generally, there is no satisfactory single exercising device which can achieve all of the abovementioned exercises. Free weights provide only a limited source of exercises. Tricep presses have been devised but these generally have limited application.

OBJECT AND STATEMENT OF THE INVENTION

Accordingly, it is an object of the present invention to attempt to provide an exercise device which can be used for one or more of the aforementioned exercises.

Therefore, in accordance with a first broad aspect of the present invention there may be provided an exercise device comprising frame means, an endless rope, cord or like means and means for applying a friction thereto mounted to said frame means, the arrangement being such that the means for applying friction will apply a restraint to the rope, cord or like means which must be overcome by an exercising person pulling on the rope, cord or like means.

Most preferably, the rope, cord or like means passes over a wheel, and the wheel has a surface which is engaged by the friction applying means.

Most preferably the friction applying means can be adjusted to provide different degrees of restraint thereby permitting an exercising person to adjust the restraint to suit the required exercise.

Most preferably the rope, cord or like means is a chain.

BRIEF DESCRIPTION OF THE DRAWINGS

In order that the invention can be more clearly ascertained examples of preferred embodiments will now be described with reference to the accompanying drawings wherein.

DETAILED DESCRIPTION OF PREFERRED EMBODIMENT

Figure 1:
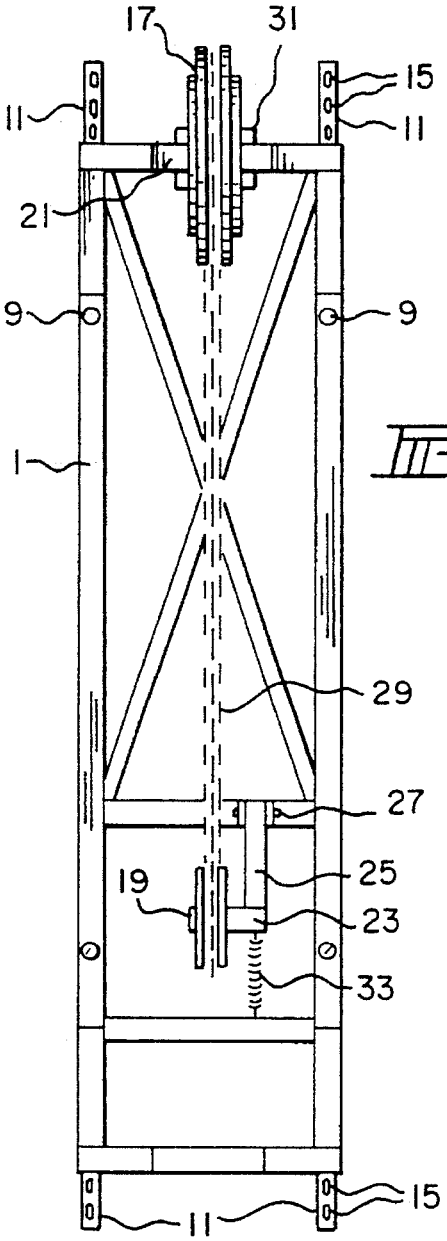
FIG. 1 is a front elevational view of a first preferred exercise device.
Figure 2:
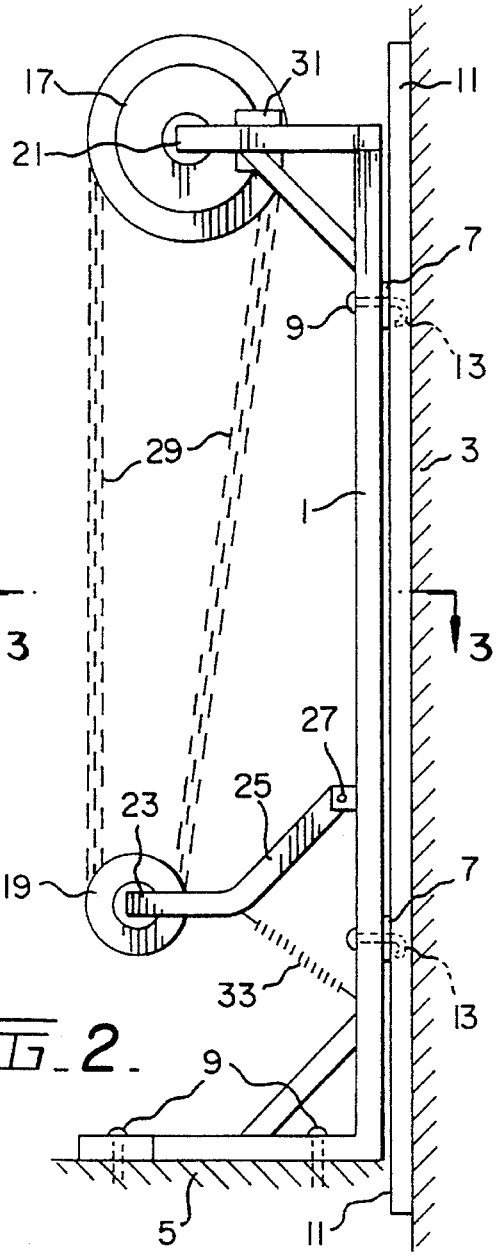
FIG. 2 is a side view of the exercise device shown in FIG. 1.
Figure 4:
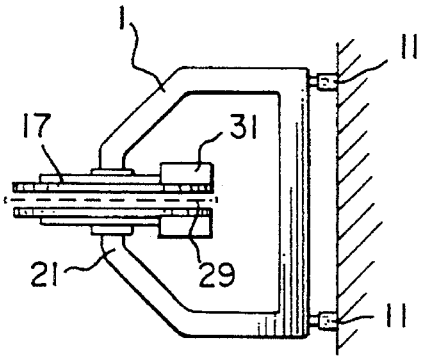
FIG. 4 is a plan view of the device shown in the previous figures.
Figure 3:
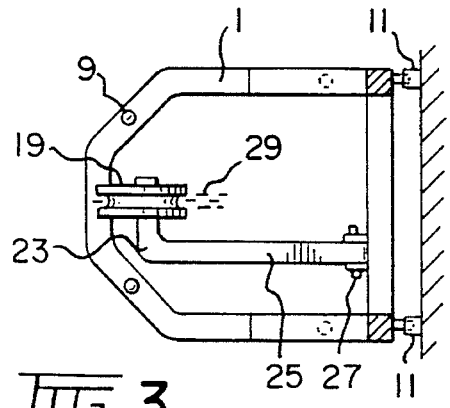
FIG. 3 is a sectional view taken in the direction of arrows A—A on FIG. 2.

Referring now to all of FIGS. 1 to 4, there is shown an exercise device comprising a frame means 1 fabricated from rectangular shaped tubular steel. The frame means 1 may be suitably welded and chrome plated to inhibit against corrosion. The frame means 1 can be mounted to a wall 3 or can be floor mounted to a floor 5 (as shown only in FIG. 2). If desired, it may be mounted to both a floor 5 and a wall 3. The frame means 1 is supported in spaced relation to the wall 3 by spacers 7 and by bolts 9 which pass through the spacer 7.

If desired, a sub-frame 11 may be mounted to the wall 3 and the frame means 1 hooked to the sub-frame 11 by the bolts 9 having downturned ends 13 which can pass through pre-punched slots 15 in the sub-frame 11. Thus, the frame means 1 can be raised or lowered relative to the sub-frame 11 if required. This can be provided to enable the exercising device to be located at a convenient operator height.

The frame means 1 carries a first wheel 17 in the form of a pulley, and a second wheel 19 also in the form of a pulley. The first wheel 17 has a central axle 21 which is mounted to permit free rotation of the first wheel 17 about the axle 21. Accordingly, the axle 21 is suitably journalled in bearings (not shown) supported by the frame means 1.

The second wheel 19 has a central axle 23 which is similarly mounted for rotation as wheel 17 and is carried by an arm 25 which, in turn, is pivoted to the frame means 1 at pivot 27 so that the arm 25 can swing upwardly and downwardly relative to the first wheel 17. This, in turn, will permit the second wheel 19 to move towards or away from the first wheel 17.

An endless rope, cord or like means 29 in the form of a steel chain passes around each of the first wheel 17 and second wheel 19 in a pulley groove formed therein. The rope, cord or like means 29 may conveniently comprise a rope, or a cord or like means but it has been found that a chain provides satisfactory results. Accordingly, any form of rope, cord or like means which is flexible and which is endless may be carried between the pulley grooves of the first wheel 17 and second wheel 19.

Means for applying friction 31 is mounted to the frame means 1 and engages with outer surfaces of the first wheel 17. Preferably, the means for applying friction 31 engages with both side surfaces of the first wheel 17 and can conveniently comprise friction pads. Means, not shown, can be utilised to urge the means for applying friction 31 against the first wheel 17 in a manner whereby the friction applied can be adjusted. This, in turn, will permit a user of the exercise device to control the amount of restraint which is subsequently applied by the means for applying friction 31 to, in turn, suit the required exercise. The means for permitting the adjustment may conveniently comprise screw-threaded means which urge opposed friction pads of the means for applying friction 31 together and press against the side faces of the first wheel 17 depending on the adjustment of the screw-threaded means.

The arm 25 is connected to a spring means 33 which, in turn, connects with the frame means 1 to swing the arm 25 in a direction away from the first wheel 17. Thus, the rope, cord or like means 29 can be held taut between the first wheel 17 and the second wheel 19. Obviously, the length of the rope, cord or like means 29 is provided to suit the spacing and variable range provided between the first wheel 17 and second wheel 19.

In use, a person stands in front of the exercise device, grasps the rope, cord or like means 29 and preferably pulls it in a downward direction. When the person's arm has moved a suitable distance, the person can release the rope, cord or like means 29 and re-grasp it at a higher position and again pull it in a downward direction. The process can be repeated a suitable number of times to provide for a required exercise.

Variations of exercises can be achieved by grasping the rope, cord or like means 29 and pulling it in an upward direction. In this instance arm 25 may be locked by suitable locking means (not shown) to inhibit it from swinging upwardly and releasing the tension on the rope, cord or like means 29 which would prevent drive to the first wheel 17 and interfere with the restraint provided by the means for applying friction 31. A further variation is where a person may lie on a horizontal bench with the exercise device behind their head. The person can then reach over their head, grasp the rope, cord or like means 29 and pull it in a required direction.

It has been found that the device disclosed is able to strengthen forearms, fingers, hands, wrists, triceps and shoulders. Thus, it has particular application as an exercise device which can be used at sporting institutions, gymnasiums, physiotherapists' rooms and other locations where exercises may be required.

Figure 5:
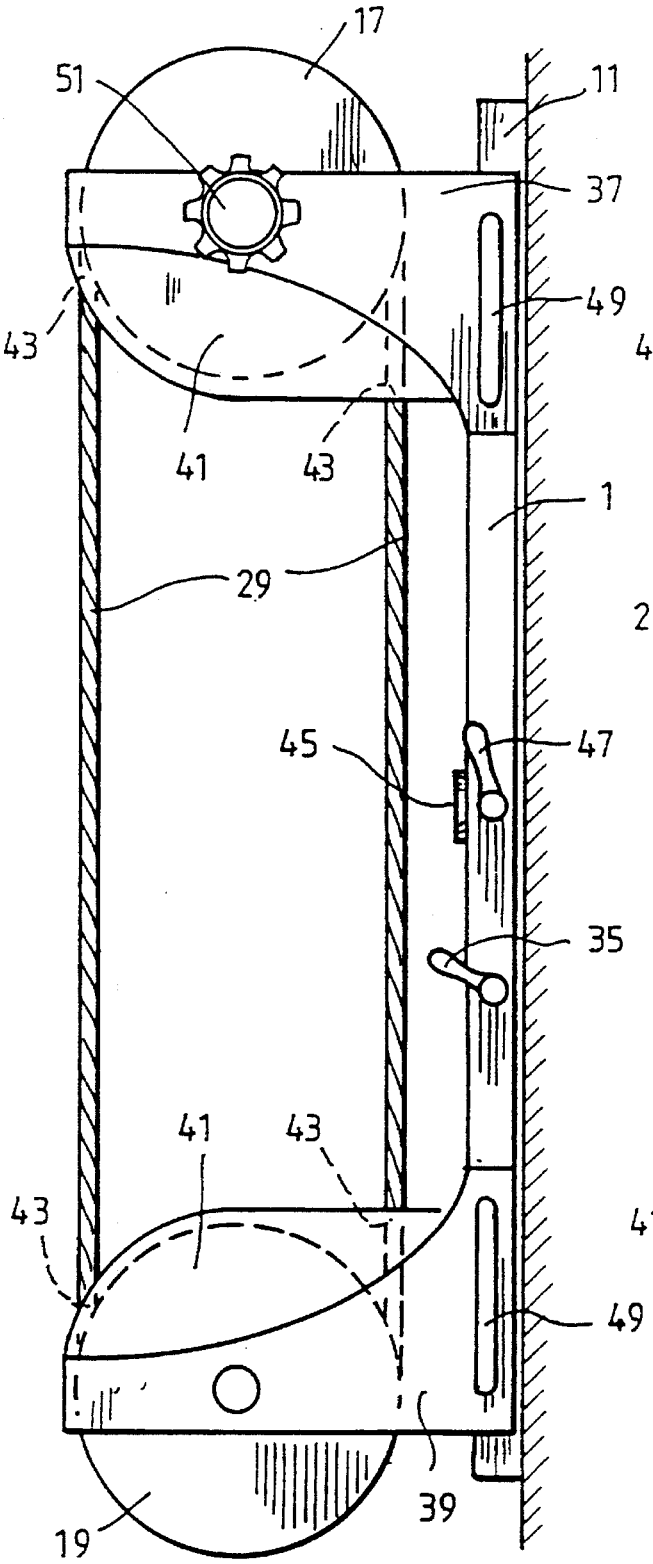
FIG. 5 is a side view of a second preferred exercise device.
Figure 6:
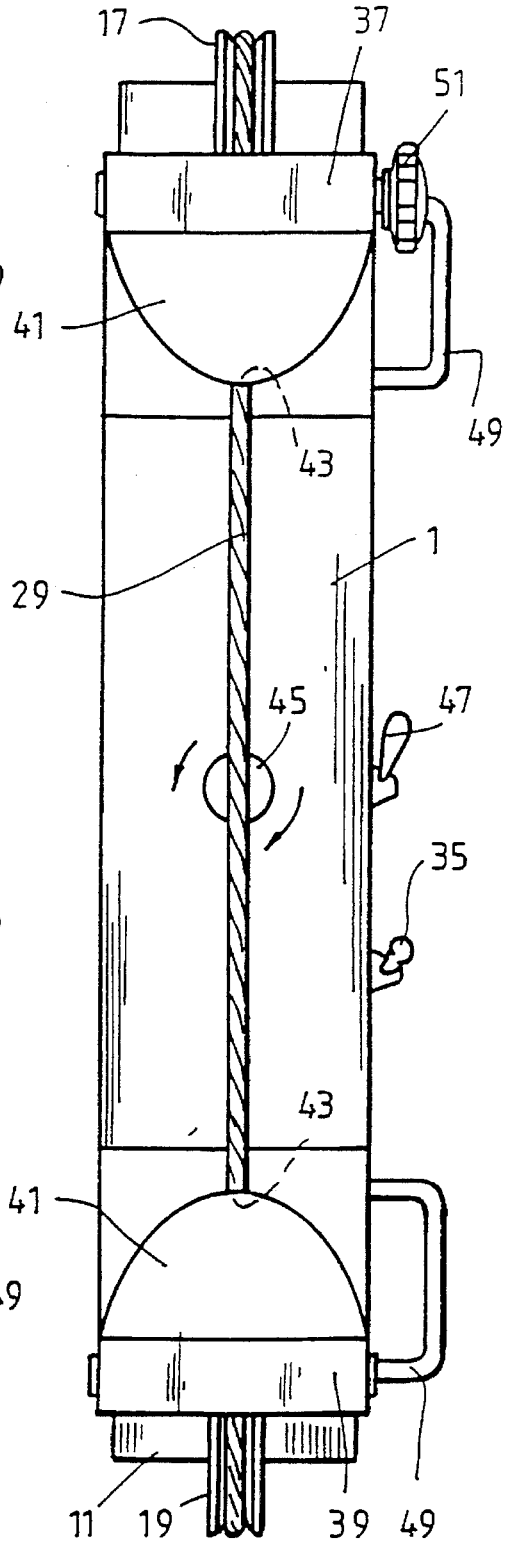
FIG. 6 is a front view of the device shown in FIG. 5.

Referring now to the second embodiment shown in FIGS. 5 and 6, it should be noted that it is generally similar to the embodiments shown in FIGS. 1 through 4 and like components have been provided with like numerical designations. Here it can be seen that there is a sub-frame 11 which is mounted to a wall 3. A frame means 1 fits over the sub-frame 11 and can be raised to a desired operator height by manipulation of a locking bolt 35 which can be used to pass into suitable apertures (not shown) in the sub-frame 11 through a side wall of the frame means 1. The frame means 1 carries an upper bracket member 37 and a lower bracket member 39. Both the upper and lower bracket members 37, 39 can be manufactured from a die-cast material such as an aluminium or aluminium alloy. The first wheel 17 is mounted to the upper bracket member 37 in suitable journalled bearings so that it can rotate. The second wheel 19 is similarly journalled into the lower bracket member 39. The rope, cord or like means 29 passes over both the first wheel 17 and the second wheel 19. Plastics material shrouds 41 extend from the upper bracket member 37 and the lower bracket member 39 and have apertures 43 therein sufficient just to allow the rope, cord or like means 29 to pass therethrough. Thus, the shrouds 41 inhibit against a person's fingers being caught between the rope, cord or like means 29 and the first wheel 17 or second wheel 19. The frame means 1 has a central pivot support 45 which is controlled by lever 47 to lock the frame means 1 relative to the sub-frame 11. Thus, by operation of lever 47, the releasable pivot support 45 can be freed to permit the frame means 1 to be rotated, as shown by the arrows, either clockwise or anti-clockwise relative to sub-frame 11. When a desired position is reached, the lever 47 may be operated to permit positive holding of the frame means 1 relative to the sub-frame 11.

Accordingly, it is possible to arrange the device so that the rope, cord or like means 29 can be manipulated at any desired angle relative to an operator. This is particularly provided to permit the device to be mounted generally extending horizontally so that the rope, cord or like means 29 extends horizontally. With the device arranged in this manner, it is possible to achieve further exercising, such as strengthening of stomach muscles and the like by pulling on the rope, cord or like means 29 in front of the operator.

Handle means 59 are provided on the upper and lower bracket members 37, 39 to permit easy grasping of the device for movement to desired angular positions about the releasable pivot support 45.

In this embodiment, a hand wheel 51 is provided to permit a user to adjust the amount of restraint which will, in turn, provide for the required friction to the first wheel 17 to suit the required exercising. Operation of the hand wheel 51 causes friction pads (not shown) to press more heavily or less heavily on the first wheel 17.

Whilst the rope, cord or like means has been disclosed preferably as a chain, it should be appreciated that in order to provide for positive gripping with the first wheel 17, that the drive gripping of the chain with the first wheel 17 may be enhanced by providing sprockets on the first wheel means 17 which pass through the centre of particular links of the chain.

It should also be appreciated that particular restraint may be applied by inserting weights or the like onto a lever mechanism which permits the weights to act on the means for applying friction 31 to adjust the restraint. Thus, in gymnasiums in particular, a person can easily and visually determine the required restraint by applying particular weights to the device which will, in turn, adjust the means for applying friction 31.

These and other modifications may be made without departing from the ambit of the invention, the nature of which is to be determined from the foregoing description.

I claim:

1. An exercise device comprising frame means, a wheel mounted to said frame means, a second wheel mounted to said frame means spaced from said first wheel, and an endless rope, or cord, passing over the wheels, the spacing of said wheels keeping the rope, or cord, taut, means for applying friction to one of said wheels mounted to said frame means which will apply a restraint to the rope, or cord, which must be overcome by an exercising person pulling on the rope, or cord, and wherein said frame means is rotatably mounted to a sub-frame by a central pivot support for rotation relative to said sub-frame only about said central pivot support, said sub-frame being for supporting said device by said frame means relative to a floor and wherein locking means is provided to permit a desired angle of rotation of said sub-frame about said central pivot support to be held for particular arm related exercises, said mounting by said central pivot support permitting rotation so said rope, or cord, between said first wheel and said second wheel can extend between vertically and horizontally extending user operable positions.

2. An exercising device as claimed in claim 1 wherein the means for applying friction engages a side face of one of said wheels.

3. A device as claimed in claim 1 wherein the means for applying friction is manually adjustable to provide different degrees of restraint permitting an exercising person to adjust the restraint to suit a required arm exercise.

4. A device as claimed in claim 1 wherein the means for applying friction comprising friction pad means engageable on the side face of one of said wheels.

5. A device as claimed in claim 1 wherein said frame means is detachably mounted to said sub-frame and hook means is provided to permit the height position of said frame to be adjusted relative to said sub frame thereby permitting a convenient user height position to be obtained.

* * * * *